US005609089A

United States Patent [19]

Leidinger

[11] Patent Number: 5,609,089

[45] Date of Patent: Mar. 11, 1997

[54] CONTROL FOR DIVIDING THE OUPUT FLOW IN HYDRAULIC SYSTEMS TO A PLURALITY OF USERS

[75] Inventor: Gustav Leidinger, Friedberg, Germany

[73] Assignees: O&K Orenstein; Koppel AG, both of Dortmund, Germany

[21] Appl. No.: 352,774

[22] Filed: Dec. 1, 1994

[30] Foreign Application Priority Data

Dec. 3, 1993 [DE] Germany ..... 43 41 244.0

[51] Int. Cl.[6] ..... F15B 11/08; F15B 13/04

[52] U.S. Cl. ..... 91/516; 91/445; 91/447

[58] Field of Search ..... 60/422, 426, 452; 91/532, 512, 514, 517, 518, 445, 447, 448, 516, 446

[56] References Cited

U.S. PATENT DOCUMENTS

| | | | |
|---|---|---|---|
| 5,067,389 | 11/1991 | St. Germain | 91/447 X |
| 5,174,114 | 12/1992 | Aoyagi | 91/446 |
| 5,207,059 | 5/1993 | Schexnayder | 91/445 X |
| 5,209,063 | 5/1993 | Shirai et al. | 60/422 |
| 5,251,444 | 10/1993 | Ochiai et al. | 60/426 X |
| 5,259,192 | 11/1993 | Karakama et al. | 60/422 |
| 5,271,227 | 12/1993 | Akiyama et al. | 60/422 |
| 5,279,122 | 1/1994 | Shirai et al. | 60/452 |
| 5,291,821 | 3/1994 | Yamashita et al. | 91/447 |
| 5,415,199 | 5/1995 | Claudinon et al. | 91/512 X |
| 5,446,979 | 9/1995 | Sugiyama et al. | 60/422 X |
| 5,535,663 | 7/1996 | Yamashita et al. | 91/447 X |

FOREIGN PATENT DOCUMENTS

| | | | |
|---|---|---|---|
| 3603630 | 8/1987 | Germany . | |
| 4036720 | 5/1992 | Germany . | |
| 4041288 | 6/1992 | Germany . | |
| 2-309004 | 12/1990 | Japan | 60/426 |
| 2-309005 | 12/1990 | Japan | 60/426 |
| 6-159309 | 6/1994 | Japan | 60/452 |

OTHER PUBLICATIONS

O + Ölhydraulik und Pneumatik [O + P Oil Hydraulics and Pneumatics], 35, (1991) No. 9, pp. 717 to 723, "Regelung hydraulischer Antriebe mit veränderlichem Versorgungsdruck".

Off Highway Capability –Wheeled Loaders of the Vickers Company. 21 Feb. 1989.

Mannesmann Rexroth Catalog –RD 64291/03.92, pp. 163 to 166 –load sensing control block M7 series with LITD in mixed construction Mono + Sandwich.

*Primary Examiner*—John E. Ryznic
*Attorney, Agent, or Firm*—Spencer & Frank

[57] ABSTRACT

A control is proposed for dividing the output flow in hydraulic systems made available by at least one pump to a plurality of users according to the load pressure-independent principle in case of output flow undersupply of the users, wherein a compensator is connected downstream of each control slide valve provided with a predeterminable control cross section, with the compensator including a piston and actuating element and each user connected downstream of the compensator receiving a predeterminable portion of the output flow as a function of the degree of undersupply by the pistons of the compensators, with the piston being acted upon by different forces which bring about different opening pressures.

5 Claims, 5 Drawing Sheets

CONTROL FOR DIVIDING THE OUPUT FLOW IN HYDRAULIC SYSTEMS TO A PLURALITY OF USERS

BACKGROUND OF THE INVENTION

The invention relates to a control for dividing the output flow in hydraulic systems made available by at least one pump to a plurality of users according to the load pressure-independent principle given an output flow undersupply of the users, in particular, for construction machinery such as wheeled loaders, graders, excavators or the like.

For economical and technical-reasons it is often necessary to dimension hydraulic systems such that the output flow of the pump (or pumps), when the flow is fed simultaneously to two or more users, is no longer sufficient for supplying each user with the desired design output flow. This state is defined as undersupply of the individual users (e.g. cylinders) and is also present, for example, in the design of construction machinery, in particular, wheeled loaders, graders, excavators or the like, in which the selection of the pump size is such that the output flow can no longer guarantee the required adjustment times of the cylinders that are or can be actuated simultaneously, as can be demonstrated, for example, in the hoisting gear and tipping gear of a wheeled loader.

Given such an undersupply, a decision must be made when designing the hydraulic system regarding the extent to which the available output flow is distributed to the individual users. Hydraulic systems with control slide valves based on the throttle principle are not capable of dividing an output flow when the slide valve piston is switched through, because, already at a very small pressure difference between the users, the entire output flow flows to the user with the lesser load.

The load pressure-independent (load sensing) system, on the other hand, offers the possibility of dividing the output flow to the individual users according to certain criteria. In order to obtain, under the given conditions of the respective application, the most favorable motional flow of the components actuated by the hydraulic users (e.g., cylinders) such as, e.g., lifting frames, booms, etc., it is necessary to divide the output flow according to a certain ratio.

To date, solutions are known in which, depending on the embodiment, a division is provided which is fixed or which depends on outside conditions. This applies, inter alia, for the following embodiments:

Pressure scales connected in parallel in the feed to each piston valve (0+P Öhydraulik und Pneumatik [O+P Oil Hydraulics and Pneumatics], 35 (1991) No. 9, pages 717 to 723—Regelung hydraulischer Antriebe mit ver änderlichem Versorgungsdruck [Control for Hydraulic Drives with Variable Supply Pressure]). In case of undersupply, the user with the lower pressure requirement is fed an increasing higher portion of the output flow when the differential pressure between the users increases. Given a 50% degree of supply of two users having the same nominal through-flow rate, the user with the lower pressure load already receives the entire output flow when the pressure difference compared to the user with the higher load corresponds to the control pressure of the pressure scale. Since the control pressure of the pressure scale is in the magnitude of 5–20 bar, the entire output flow will therefore be respectively fed to another user at low changing pressure differentials.

Priority pressure scales may also be connected in series in the feed to each control slide valve. When two or more users are actuated simultaneously, the user which is disposed closer to the pump respectively receives the desired volume in the course of the pump channel, while the remaining stream is offered to the further users. Therefore, given a 50% degree of supply of two users having the same nominal through-flow rate, the user which is disposed closest to the pump connection in the slide valve receives the entire output flow (Off Highway Capability—Wheeled Loaders of the Vickers Company).

Load pressure-independent through-flow distribution (LITD) due to a compensator connected downstream of every control slide valve, with the compensator system known to date consisting essentially of a piston and spring. Here, each user receives a proportionally lower output flow depending on the degree of undersupply. Thus, given a degree of supply of 50% and two users, each receives 50% of its nominal rate, regardless of whether the users are designed for identical or different nominal through-flow rates (Mannesmann Rexroth Catalog—RD 64291/03.92, pages 163, 164 and 166—load sensing control block M7 series with LITD in mixed construction Mono+Sandwich).

SUMMARY OF THE INVENTION

It is the object of the subject matter of the invention to configure the control mentioned in the introduction such that the requirements to be met by the operating hydraulics, in particular, of construction machinery, are fulfilled in such a manner that, in case of undersupply and when two or more users are actuated simultaneously, the ratio of the output flows flowing to these users is different than the ratio of the nominal through-flow rates of these users, while this ratio should also not be influenced by the load (cylinder) pressures.

In a control for dividing the output flow in hydraulic systems made available by at least one pump to a plurality of users according to the load pressure-independent principle given an output flow undersupply of the users, in particular, for construction machinery such as wheeled loaders, graders, excavators or the like, this object is achieved in that a compensator is connected downstream of each control slide valve provided with a predeterminable control cross section, with the compensator comprising essentially a piston and actuating element, and each user connected downstream of the compensator receiving a predeterminable portion of the output flow as a function of the degree of undersupply by the pistons of the compensators opening the passage cross sections to the users at different opening pressures using differently exerted forces of the pistons' actuation elements.

So as to reach the predeterminable division of the output flows according to the invention, a control slide valve according to the load pressure-independent (load-sensing) principle with downstream compensators is selected, with the opening pressure of the pistons being different, because, for example, the forces of the springs are selected to be different. Thus, via the selection of different spring forces as well as the dimensioning of the cross section openings of the slide valves, the output flow can be divided as desired based on a priority among two or more users as a function of the magnitude of the degree of undersupply resulting from the maximum output flow of the pump (or pumps).

In addition to the springs as actuating element, the opening pressure of the pistons can also be effected by hydraulically, pneumatically or electromagnetically loaded plungers, with these solutions allowing a change of the opening pressure in a simple manner, also in the operating state of the machine. A combination of spring and plunger having a predetermined or predeterminable division ratio of the forces effecting the total opening pressure is also conceivable.

As a consequence of the priorities resulting as a function of the actuation of the control slide valves, movements that are superposed on one another can also be carried out advantageously, which significantly improve the ease of operation of the respective machine. The arrangement according to the invention has an equally advantageous effect, if the hydraulic system is operated in such a manner that the full cross section of the control slide valve is opened for one user and the control cross section to be opened for one or, alternatively, also for a plurality of other users is changed continuously. If, for example, the hand lever for the lifting gear is fully pulled through, as is customary in the operation of a wheeled loader, while the lever for the tipping gear is actuated according to the momentary requirements with respect to material pick-up, the condition described above takes hold.

In an excavator, the above-described process of superposed motion would be present, for example, if the cylinders for boom, arm and dipper would be actuated at the same time.

BRIEF DESCRIPTION OF THE DRAWINGS

The invention is illustrated in the drawing by way of an embodiment and is described as follows. The drawings show.

DETAILED DESCRIPTION OF THE INVENTION

Figure 1:
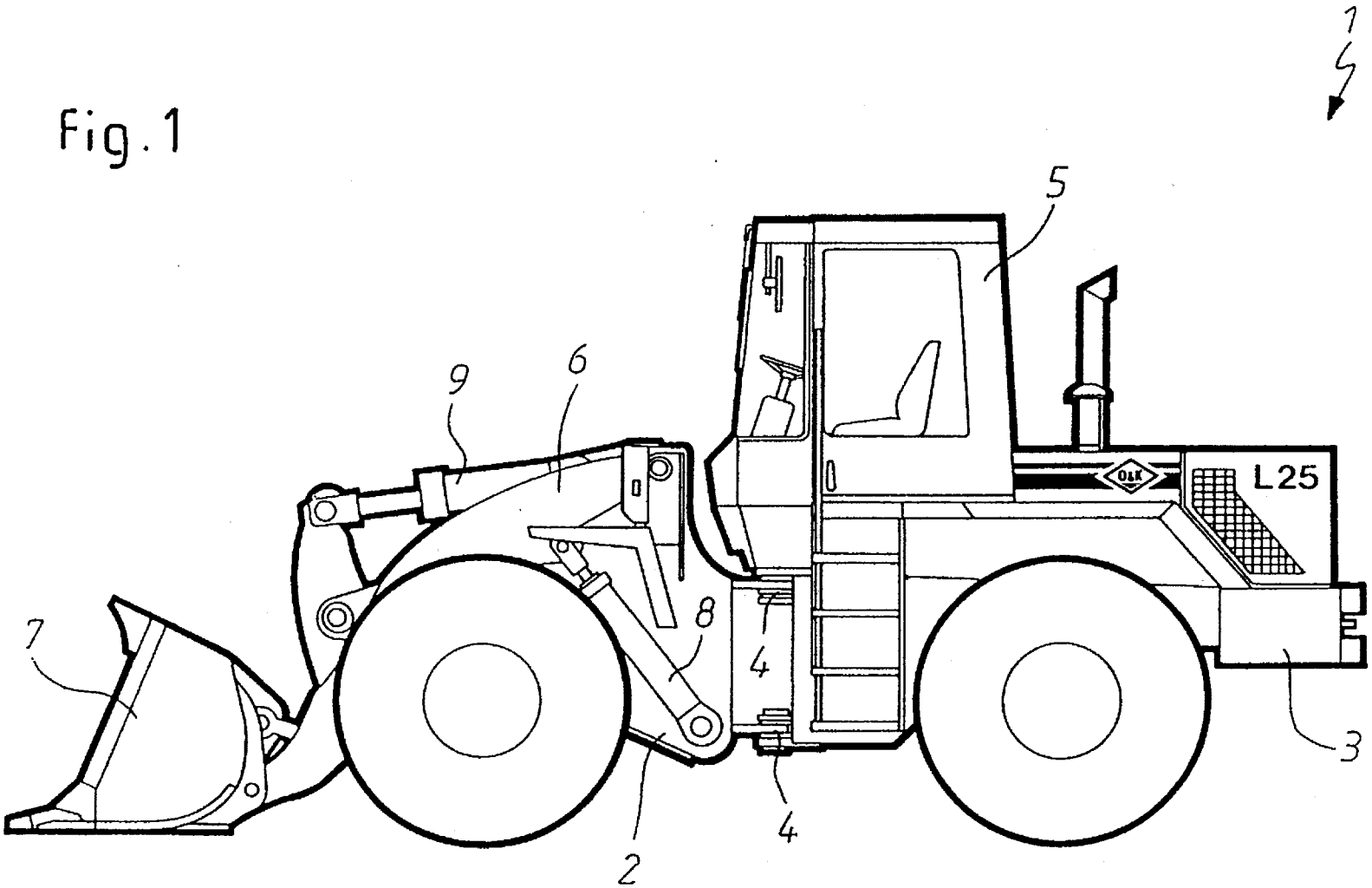
FIG. 1—schematic diagram of a wheeled loader

FIG. 1 shows a wheeled loader 1 comprising essentially the following components:

a front carriage 2, a rear carriage 3, both being connected with each other via an articulated joint 4. In the region of the front carriage 2, a lifting frame 5 is provided which carries a loading bucket 7 at its free end. The lifting frame 5 can be lifted and lowered via hydraulic cylinders 8 configured as users, while the bucket 7 can be tilted up and dumped by means of a further user in the form of a hydraulic cylinder 9.

Figure 2:
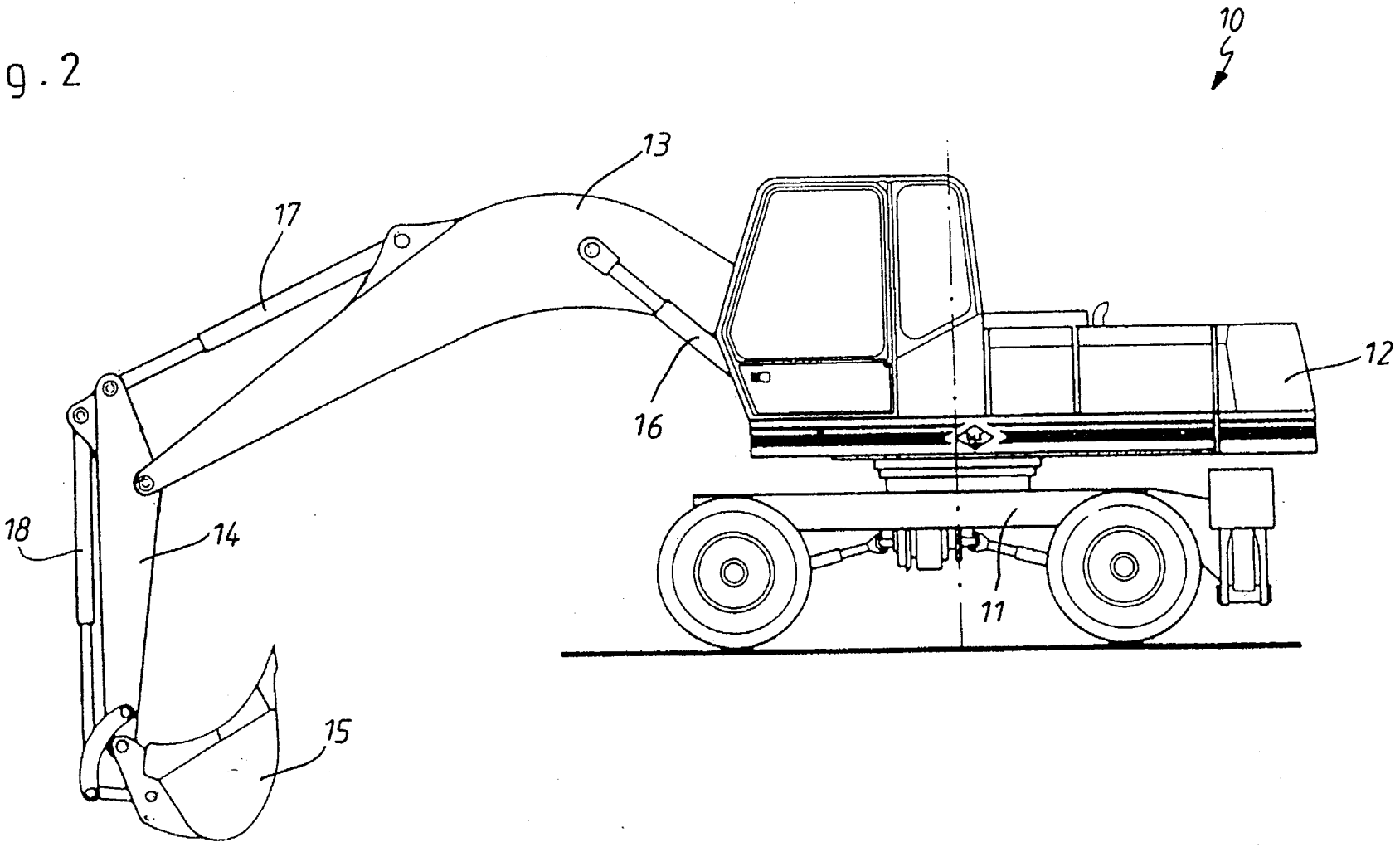
FIG. 2—schematic diagram of an excavator

FIG. 2 shows a hydraulic excavator 10 which is provided with an upper carriage 12 which is rotatable with respect to an undercarriage 11, with equipment comprising boom 13 and arm 14 being articulated to the upper carriage 12. The arm 14, in turn, carries a swivel loading bucket 15 at its free end. The boom 13 can be moved via hydraulic cylinders 16 with respect to the upper carriage 12, while the arm 14 can be actuated by means of a further cylinder 17. The swivel motion of the loading bucket 15 with respect to the arm 14 is also brought about via a hydraulic cylinder 18.

The users 8, 9 according to FIG. 1 and the users 16–18 according to FIG. 2 are each supplied via one or a plurality of variable displacement pump(s) not shown in detail, whose total output flow corresponds to the nominal through-flow rate of only one of the users (FIG. 1) or of approximately two users (FIG. 2). If both users 8, 9 are now fully acted upon according to FIG. 1, the output flow made available by the pump is not sufficient to supply both users 8, 9 with the output flow that is respectively required. The techniques known to date are described in the introduction, but these are not satisfactory under conditions of undersupply. The essence of the invention is displayed in the FIGS. 3 through 5.

Figure 3:
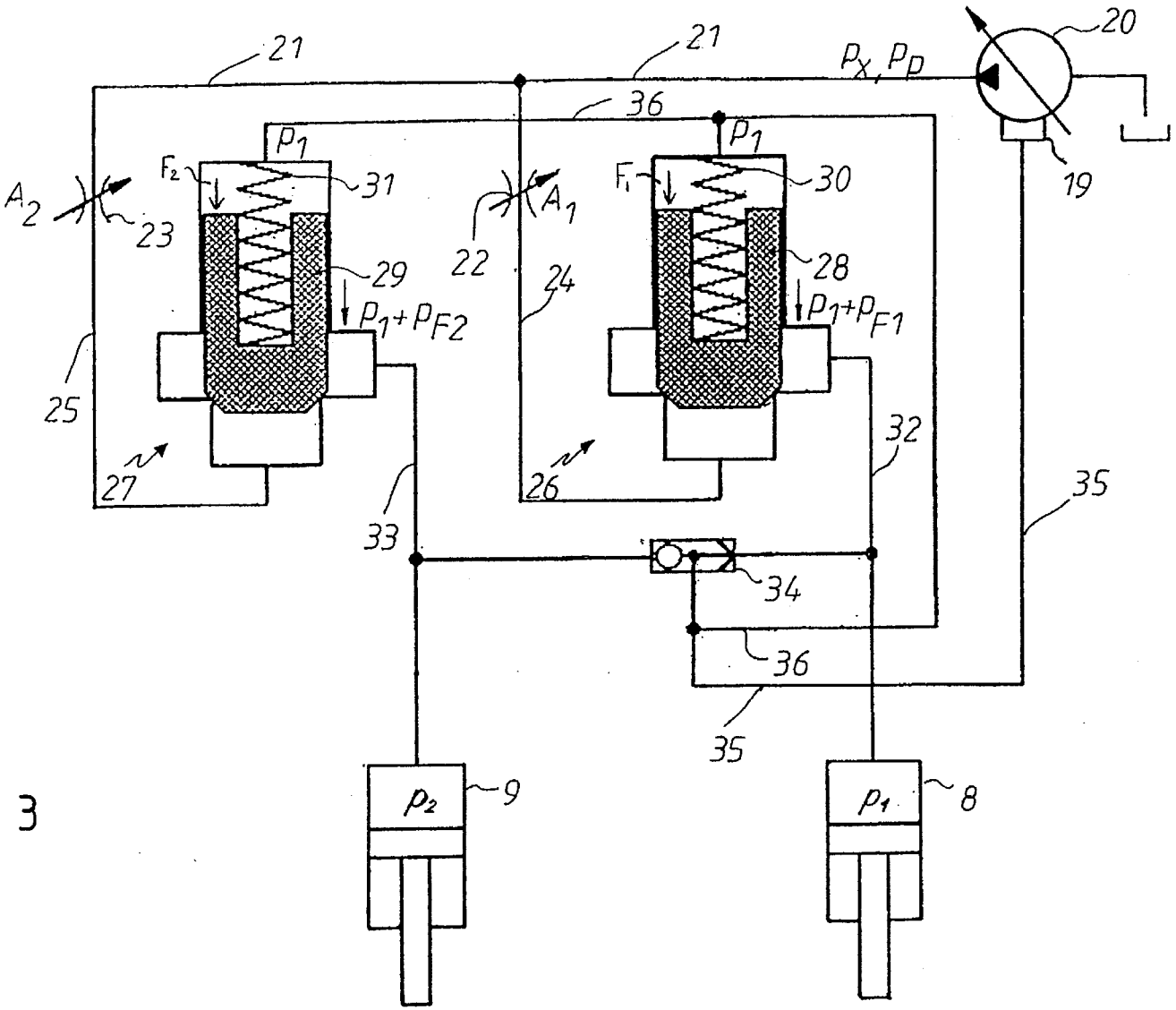
FIG. 3—schematic diagram of an LITD slide valve having the features according to the invention FIG. 4—graphic representation of the division of the output flow for one of the users according to FIG. 1

The hydraulic system shown in FIG. 3, which can be used, for example, for a wheeled loader 1 according to FIG. 1, comprises one single variable displacement pump 20 which is provided with a load sensing controller 19, with the pump being operatively connected with the control slide valves 22, 23 via a feed line 21. The control slide valves 22, 23 are provided with control cross sections $A_1$ and $A_2$ which are identical or different depending on the design. Via further lines 24, 25, a compensator 26, 27 is respectively connected downstream of the control slide valves 22, 23, with the compensator comprising a piston 28, 29 and a spring 30, 31 as an actuating element, shown in a simplified manner in this illustration. Other actuating elements such as, for example, plungers that can be actuated hydraulically, pneumatically or electromagnetically, can also be configured. The compensators 26, 27 are operatively connected via further lines 32, 33 to the downstream users, here the hydraulic cylinders 8, 9 shown according to FIG. 1. In this process, different pressures $p_1$ and $p_2$ act upon the users 8, 9 by means of the outside forces affecting the users. In a wheeled loader 1 or an excavator 10, theses are, for example, the lifting forces and breakout forces or digging forces during the material pick-up. In a grader these may be the cutting forces acting upon the blade.

When actuating the control slide valves 22, 23 of the hydraulic system operating according to the load pressure-independent principle, the output flow of the variable displacement pump 20 is divided according to the invention in accordance with a predeterminable ratio by making the opening pressures of the pistons 28, 29 different by means of differently selected forces $F_1$, $F_2$ of the springs 30, 31.

For a better understanding of the hydraulic system according to the invention, only two users 8, 9 are illustrated here, whose number, however, may also be higher, e.g., in excavators or graders. The same applies to the number of the pumps which jointly feed into the supply line 21. The respectively highest user pressure (in this example $p_1$) is indicated to the controller 19 of the variable displacement pump 20 via a shuttle valve 34 via the line 35. Furthermore, the highest pressure $p_1$ is also transmitted via the line 36 to the spring end of the pistons 28, 29. The closing pressure of the piston 28 is thus made up of the highest user pressure $p_1$ and the pressure $p_{F1}$ originating from the associated spring 30; the closing pressure of the piston 29 is at $p_1$ plus $p_{F2}$, wherein $p_{F1}$ and $p_{F2}$ correspond to those pressures on the piston face which keep the balance with respect to the respective spring force. Given a normal supply of the users 8, 9, the variable displacement pump 20 continues to deliver an output flow having a pressure $p_p$ which is above the highest load pressure $p_1$ by the load-sensing differential pressure $p_{LS}$ as long as the control cross sections $A_1$, $A_2$ opened during the actuation of the control slide valves 22, 23 are kept so small that the total output flow is smaller or, at maximum, equal to the maximum output flow $Q_{max}$ of the variable displacement pump 20. Up to the saturation limit each of the users 8, 9 receives the desired amount of flow $Q_{1S}$, $Q_{2S}$ predetermined by the cross section $A_1$, $A_2$, such desired amounts being calculated for the user 8 by $$Q_{1S}=k\times A_{1S}\times\sqrt{p_p-(p_1+p_{F1})}$$

Analogously, the value for the user 9 is $$Q_{2S}=k\times A_{2S}\times\sqrt{p_p-(p_1+p_{F2})}$$

In the value k, the physical quantities and the conversion factors of the flow equation as well as the stream contraction coefficient are considered. The differential pressure occurring at the respective control cross section $A_1$, $A_2$, which determines the through-flow quantity therefore amounts to $$p_p-(p_1+p_{F1})$$

or $$p_p-(p_1+p_{F2}).$$

But since, at saturation, the following also applies equally to both users:

$$p_p=p_{LS}+p_1,$$

the oil flow to the users 8, 9 becomes $$Q_{1S}=k\times A_{1S}\times\sqrt{p_{LS}-p_{F1}}$$

or $$Q_{2S}=k\times A_{2S}\times\sqrt{p_{LS}-p_{F2}}\ .$$

Therefore, the maximum output flow that can be supplied by the variable displacement pump 20 at the saturation point equals $$Q_{max}=Q_{1S}+Q_{2S}.$$

If, due to a further actuation of the control slide valves 22, 23, the opened cross sections $A_1$ and $A_2$ are now enlarged further, the state of undersupply occurs, because by its design the variable displacement pump 20 is now no longer in the position to deliver the output flows requested by the control valves 22, 23. The output flow supplied by the variable displacement pump 20 will then show a value $p_x$, which exceeds the highest load pressure $p_1$ by less than $p_{LS}$ and which is therefore lower than the pump pressure $p_p$ at saturation. This is the case, because the maximum oil flow $Q_{max}$ supplied by the variable displacement pump 20 now only requires a smaller pressure gradient to pass through the cross sections $A_1$ and $A_2$. The output flow $Q_{max}$ now divides itself according to $$Q_1=k\times A_1\times\sqrt{p_x-p_{F1}}$$

or $$Q_2=k\times A_2\times\sqrt{p_x-p_{F2}}$$

If the ratio of the output flows at saturation was $$\frac{Q_{2S}}{Q_{1S}}=\frac{k\times A_{2S}\times\sqrt{p_{LS}-p_{F2}}}{k\times A_{1S}\times\sqrt{p_{LS}-p_{F1}}}$$

-continued it is $$\frac{Q_2}{Q_1}=\frac{k\times A_2\times\sqrt{p_x-p_{F2}}}{k\times A_1\times\sqrt{p_x-p_{F1}}}$$

in case of undersupply. This means that in case of undersupply, a larger portion of the oil flow flows to the user 9 with $Q_2$, user 9 being supplied via compensator 27 with the lesser spring force and thus with the opening pressure $p_{F2}$ of the piston 29.

A numerical example is intended to elucidate the preceding theoretical assumptions. If, for purposes of simplifying the calculation, it is assumed that $A_{2S}$ is equal to $A_{1S}$ and that this ratio 1:1 is also maintained while the slide valve is opened further so that $A_2$ also remains equal to $A_1$, then, given the following design of pump controller 19 and compensators 28, 29, the following applies:

- load sensing differential pressure: $p_{LS}$=14 bar
- opening pressure through spring force: $p_{F1}$=10 bar
- opening pressure through spring force: $p_{F2}$=4 bar.

Accordingly, the following division ratio $Q_{2S}$: $Q_{1S}$ results at saturation $$\frac{Q_{2S}}{Q_{1S}}=\frac{\sqrt{14-4}}{\sqrt{14-10}}=1.58$$

If, because of corresponding further cross section opening $A_1$ and $A_2$, the degree of supply is reduced to an extent that already at an excess pressure of, e.g., $p_x$=11 bar above the highest load pressure $p_1$ the entire output flow can flow to the users 8 and 9, then $$\frac{Q_2}{Q_1}=\frac{\sqrt{11-4}}{\sqrt{11-10}}=2.64$$

results as the division ratio.

Thus, as desired, with $Q_2$ a higher portion of the output flow $Q_{max}$ flows to user 9.

By further changing the control cross sections $A_1$ and $A_2$, one can now reach a position in which full priority is given to user 9, i.e., it is supplied with the total output flow $Q_{max}$. This is the case when the degree of undersupply reaches such a high level that the pump excess pressure $p_x$ drops to the level $p_{F1}$, because then the compensator 26 for the user 8 no longer opens. Then the following applies $$\frac{Q_2}{Q_1}=\frac{\sqrt{10-4}}{\sqrt{10-10}}=\infty$$

This is the case when $Q_1$ equals 0 l/min.

In this manner, the output flow can be divided as desired based on a priority favoring user 9 compared to user 8, e.g., via the selection of different spring forces as well as the dimensioning of the control cross sections $A_1$, $A_2$ of the slide valves 22, 23 as a function of the magnitude of the degree of undersupply resulting from the maximum output flow of the variable displacement pump 20.

In the preceding text it was explained how the division ratio comes about when the average cross sections change simultaneously. The arrangement according to the invention has an equally advantageous effect if the hydraulic system is actuated in such a manner that for one user, e.g., 8, the full control cross section $A_1$ is opened and for the other user 9 the control cross section $A_2$ which is to be opened is changed continuously. This applies, e.g., in particular to construction machinery, especially to the operating mode of a wheeled loader, in which the hand lever for the lifting frame cylinder 8 is fully pulled through, while the lever for the tipping gear cylinder 9 is actuated as a function of the momentary requirements of material pick-up. Analogously, this applies to the operation of an excavator 10 in which the hand levers for the boom 13 and the arm 14 are fully pulled through while the loadingbucket cylinder 18 is actuated variably.

Figure 4:
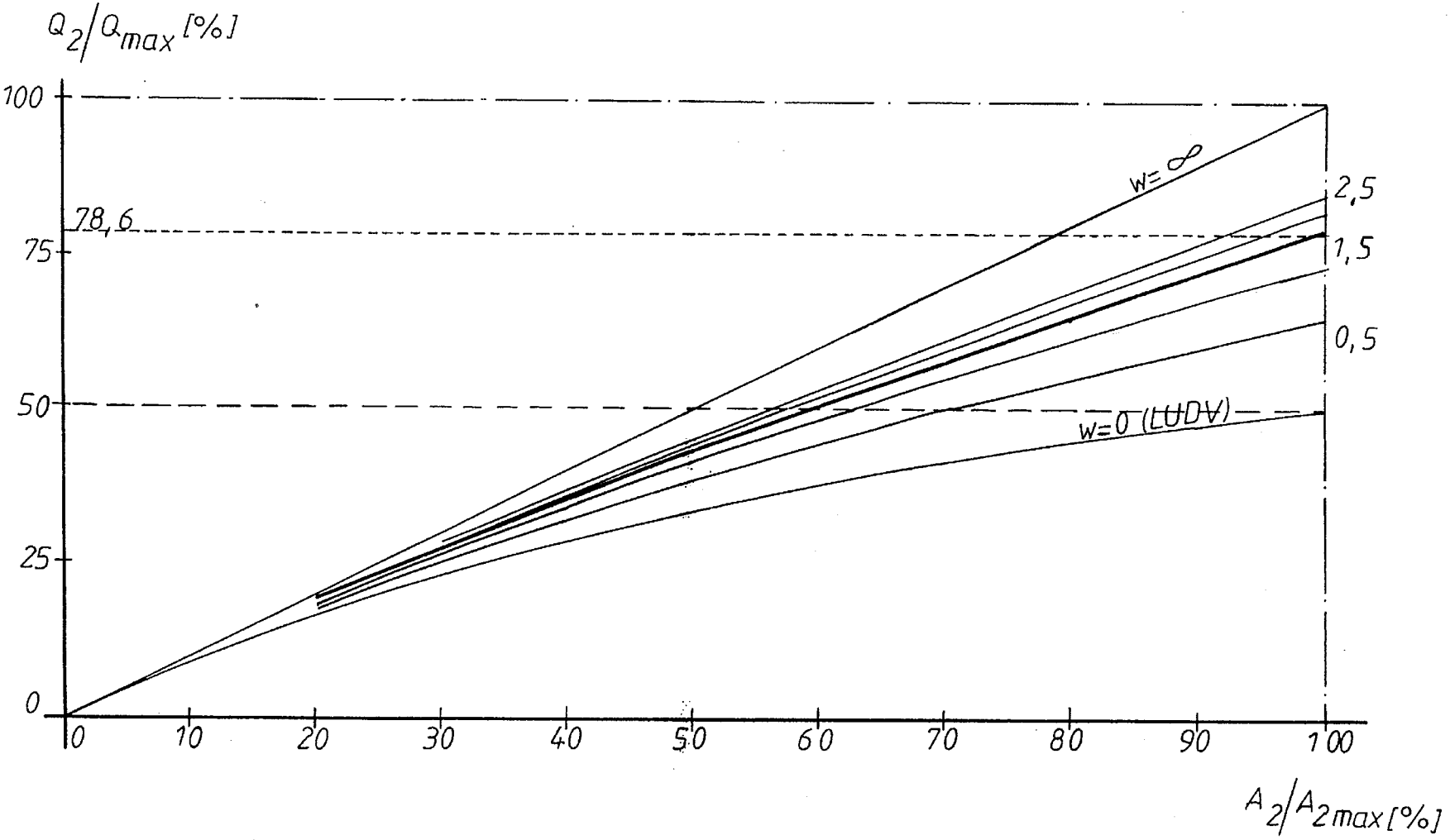

FIG. 4 is a graphic representation of the portion $Q_2$ of the user 9 in the total output flow $Q_{max}$ according to FIG. 1 based on the assumption that the control cross section $A_1$ is fully opened for the user 8 in all operating conditions. FIG. 4 is based on the assumption that the control cross section $A_1$, $A_2$ of each control slide valve 22, 23 is designed such that, when actuated alone, the maximum pump output flow $Q_{max}$ at the given load sensing differential pressure $p_{LS}$ can pass through. The ordinate indicates the percentage portion $Q_2$ of the throttled user 9 in the total output flow $Q_{max}$, while the abscisse shows the ratio $A_2/A_{2max}$ of the momentary opening cross section to the greatest possible control cross section of the control slide valve 23.

The definite preselected portion ratio $Q_2/Q_{max}$ (wherein via the relationship $Q_1=Q_{max}$ minus $Q_2$ the division ratio $Q_2/Q_1$ can also be calculated) results from the fixing of $p_{LS}$, $p_{F1}$ and $p_{F2}$ for the two slide valves 22, 23 in the fully opened state. This ratio is selected according to the specific requirements of the respective machine. In FIG. 4, the division ratio $Q_2/Q_{max}$ and thus indirectly also $Q_2/Q_1$ with the value determining the same $$W=\frac{p_{F1}-p_{F2}}{p_{LS}-p_{F1}}$$

is indicated as a parameter.

In the known systems with load pressure-independent through-flow distribution, abbreviated as LITD, i.e., with two equally strong springs ($p_{F1}=p_{F2}$) there results at a 50% undersupply of the users 8, 9 having identical rated through-flow volumes and assuming the parameters of the preceding numerical example $$W=\frac{4-4}{14-4}=0$$

and thus a division at the maximum control cross section $A_{2max}$ of $$\frac{Q_2}{Q_{max}}=0.50 \text{ or } \frac{Q_2}{Q_1}=1.0$$

In load pressure-independent systems of a construction according to the invention, i.e., with two springs 12, 13 configured with different strengths and 50% undersupply of the users 8, 9 having identical rated through-flow volumes, the calculation is, for example, $$W=\frac{10-4}{14-10}=1.5$$

The division at $A_{2max}$ now amounts to $$\frac{Q_2}{Q_{max}}=0.786 \text{ or } \frac{Q_2}{Q_1}=\frac{0.786}{(1-0.786)}=3.67$$

If W continues to increase, the portion of the output flow $Q_2$ in the total output flow $Q_{max}$ flowing to the user 9 increases up to the theoretical value W=∞, so that, in a purely mathematical sense, full priority would be a given, which means that the entire output flow $Q_{max}$ flows to the user 9.

The curve sections disposed between the upper curve (W=∞) and the lower curve (W=0) represent predeterminable division ratios of the output flow $Q_{max}$ which may be considered in the design of the construction machine, depending on the intended function.

With an increasing reduction of the control cross section $A_2$, while maintaining the maximum control cross section $A_1$, the portion of the oil flow $Q_2$ will change according to the curve sections shown. These courses are calculated from the flow equation while considering the fact that the degree of supply, which is at 50% for the two control cross sections $A_1$, $A_2$ in the fully opened state according to the illustration of FIG. 4, increases to higher values when the control cross section $A_2$ is decreased. This occurs because the desired amount for the user 8 remains unchanged in this process, but for the user 9 it is reduced because of the reduction of the control cross section $A_2$. Related to the pump output flow $Q_{max}$, which remains unchanged, this results in a higher degree of supply of user 8, i.e., a lesser magnitude of undersupply.

Figure 5:
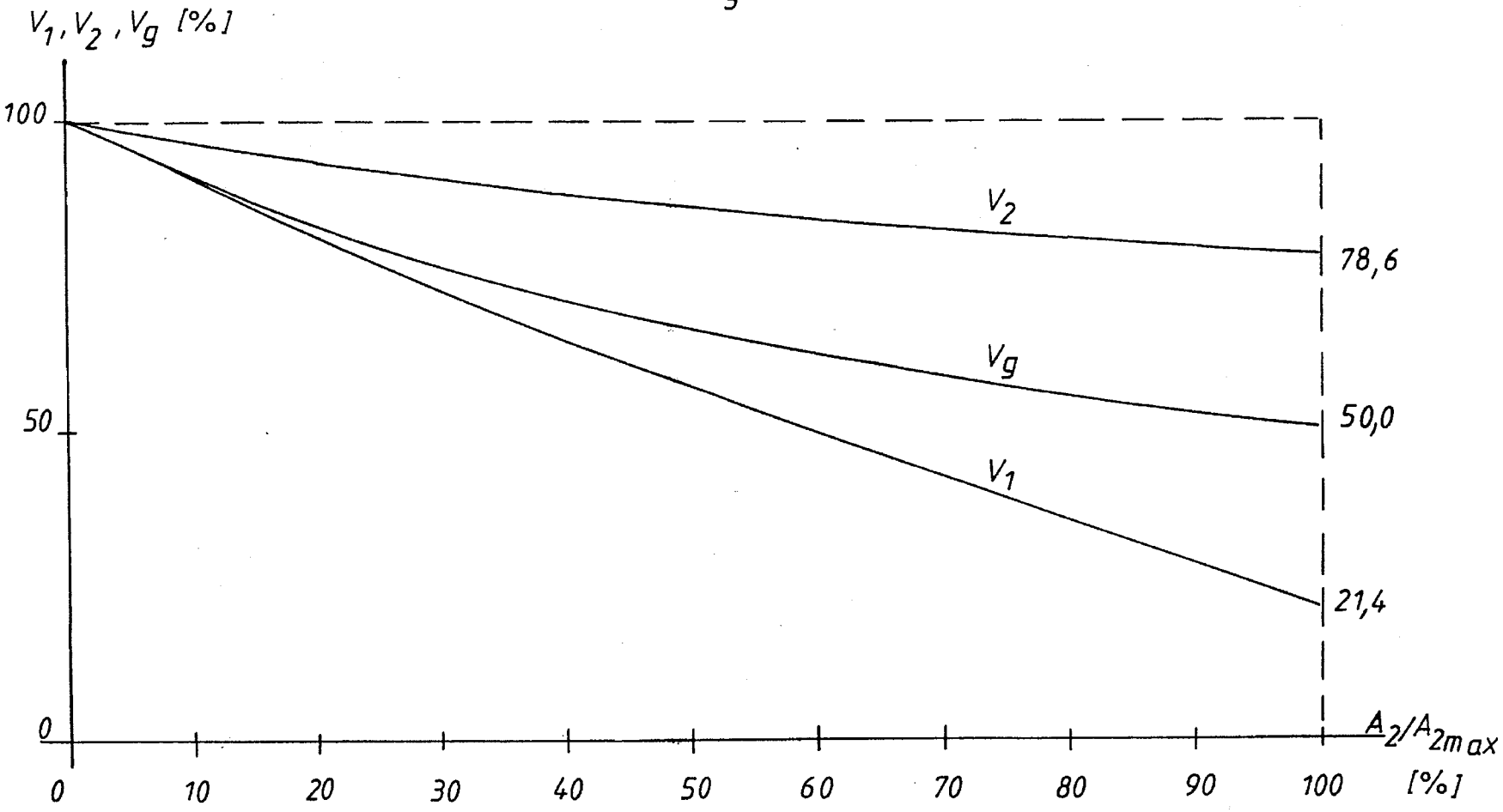
FIG. 5—graphic representation of the degrees of supply of two users as well as of the entire system.

The degrees of supply, which are respectively defined as the ratio of the actual output flow to the desired output flow, are indicated in FIG. 5 for an assumed pump output flow of $Q_{max}$=100 l/min and the value of W=1.5 assumed in the preceding text by way of example as a function of the ratio of the opening cross section $A_2/A_{2max}$ of control valve 23. The control cross section $A_1$ of control slide valve 22 is fully opened in this process.

The following applies to the degree of supply $V_2$ of the user 9

$$V_2=\frac{Q_{2actual}}{Q_{2desired}}=\frac{Q_{2actual}}{(A_2/A_{2max})\times 100}$$

as well as for the degree of supply $V_1$ of the user 8

$$V_1=\frac{Q_{1actual}}{Q_{1desired}}=\frac{Q_{1actual}}{100}$$

The total degree of supply $V_g$ of the system is defined by $$V_g=\frac{Q_{max}}{Q_{1desired}+Q_{2desired}}=\frac{100}{100+(A_1/A_{2max})\times 100}=\frac{1}{1+A_2/A_{2max}}$$

With an increasing opening of the control cross section $A_2$, which means an increasing degree of undersupply of the total system, the degree of supply $V_2$ of the user 9 decreases less than the degree of supply $V_1$ of the user 8, i.e., the degree of priority of user 9 increases as the degree of undersupply vis-a-vis the other user 8 increases.

These values in FIGURE are calculated according to the following table:

| $\frac{A_2}{A_{2max}}$ | $Q_2$ | $Q_1$ | $V_2$ | $V_1$ | $V_g$ |
|---|---|---|---|---|---|
| — | l/min | l/min | — | — | — |
| 0.0 | | 100 | 1.00 | 1.00 | 1.00 |
| 0.1 | 9.6 | 90.4 | 0.960 | 0.904 | 0.909 |
| 0.2 | 18.6 | 81.4 | 0.930 | 0.814 | 0.833 |
| 0.3 | 27.0 | 73.0 | 0.900 | 0.730 | 0.769 |
| 0.4 | 35.1 | 64.9 | 0.878 | 0.649 | 0.714 |
| 0.5 | 42.8 | 57.2 | 0.858 | 0.572 | 0.667 |
| 0.6 | 50.2 | 49.8 | 0.837 | 0.498 | 0.625 |
| 0.7 | 57.4 | 42.6 | 0.820 | 0.426 | 0.588 |
| 0.8 | 64.5 | 35.5 | 0.806 | 0.355 | 0.556 |
| 0.9 | 71.6 | 28.4 | 0.796 | 0.284 | 0.526 |
| 1.0 | 78.6 | 21.4 | 0.786 | 0.214 | 0.500 |

I claim:

1. A control assembly in a hydraulic system for dividing the output flow from at least one supply pump to at least two users on the basis of the load pressure-independent principle, comprising:

a feed line connected to the supply pump;

at least two further lines arranged in parallel to each other, and each connecting said feed line with the respective users;

at least two control slide valves, each being provided with a predeterminable control cross section, and each being arranged in a respective further line for allowing a predetermined amount of the output flow therethrough;

at least two compensators, each being connected to a respective further line downstream of a respective control slide valve and upstream of a respective user, and each comprising:

a piston that is movable to a position in which the respective further line is variably opened or closed to change an amount of the output flow that is received by the respective user; and an actuating element comprising a spring that exerts a spring force against the respective piston, each respective spring exerting a spring force that is different from a spring force exerted by the other respective spring so that each respective piston opens at a pressure different from the other respective piston; and means for interconnecting each of said compensators together so that, in case of an undersupply of flow to the users and as a result of the different spring forces acting against the respective pistons, the output flow from the supply pump is divided up based on a function of a degree of the undersupply of flow to the individual users so that each user receives a predetermined share of the output flow from the supply pump, with one user, associated with a respective compensator having a lower exerted spring force, receiving priority of the flow over the other user.

2. The control assembly defined in claim 1, wherein a degree of the priority of the flow to the one user over the other user increases with an increase in a degree of the undersupply of flow to the one user compared to the other user.

3. The control assembly defined in claim 1, wherein the springs comprise a mechanical spring, and wherein the exerted forces acting upon the respective pistons are exerted by a combination of the mechanical spring, and hydraulic actuation.

4. The control assembly defined in claim 3, wherein a division ratio of the exerted forces acting upon the respective pistons affect a total opening pressure of the respective pistons, and is predeterminably preset.

5. The control assembly defined in claim 1, wherein the users are components of construction machinery such as wheeled loaders, graders or excavators.

* * * * *

UNITED STATES PATENT AND TRADEMARK OFFICE

CERTIFICATE OF CORRECTION

PATENT NO. : 5,609,089
DATED : March 11, 1997
INVENTOR(S) : Gustav LEIDINGER

It is certified that error appears in the above-indentified patent and that said Letters Patent is hereby corrected as shown below:

On the title page, item [73] should read -- Assignee: O&K Orenstein & Koppel AG of Dortmund Germany--.

Signed and Sealed this
Tenth Day of June, 1997

*Attest:*

*Attesting Officer*

BRUCE LEHMAN

*Commissioner of Patents and Trademarks*